United States Patent [19]

Heath, Jr.

[11] Patent Number: 4,527,702

[45] **Date of Patent: * Jul. 9, 1985**

[54] TAMPER EVIDENT CONTAINER CLOSURE

[76] Inventor: Harry G. Heath, Jr., 192 Cumberland Rd., Milmay, N.J. 08340

[ * ] Notice: The portion of the term of this patent subsequent to Jul. 3, 2001 has been disclaimed.

[21] Appl. No.: 620,489

[22] Filed: Jun. 14, 1984

Related U.S. Application Data

[63] Continuation-in-part of Ser. No. 448,303, Dec. 9, 1982, Pat. No. 4,457,437.

[51] Int. Cl.[3] ..... B65D 55/02

[52] U.S. Cl. ..... 215/225; 215/252

[58] Field of Search ..... 215/224, 225, 253, 256, 215/252

[56] References Cited

U.S. PATENT DOCUMENTS

| | | | |
|---|---|---|---|
| 4,024,976 | 5/1977 | Acton | 215/256 |
| 4,190,175 | 2/1980 | Allen | 215/256 |
| 4,457,437 | 7/1984 | Heath, Jr. | 215/224 |

*Primary Examiner*—George T. Hall

*Attorney, Agent, or Firm*—B. P. Fishburne, Jr.

[57] ABSTRACT

A tamper evident child-resistant container closure is rendered further tamper evident and resistant to prying off with an implement through provision of an interfitting complete circle recess in the upper face of the container dust ring and a depending tamper evident full circle skirt extension on the closure side wall.

6 Claims, 6 Drawing Figures

FIG. 1
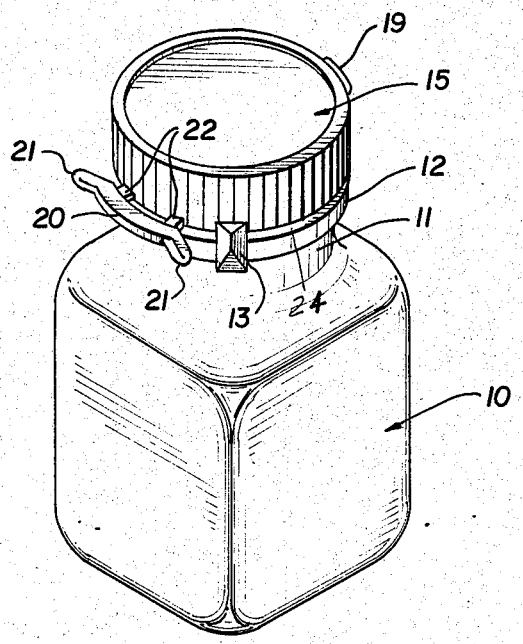
FIG. 2
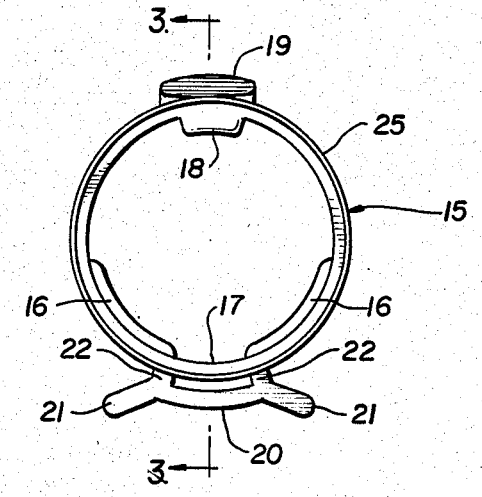
FIG. 3
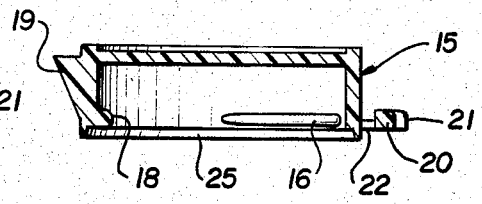
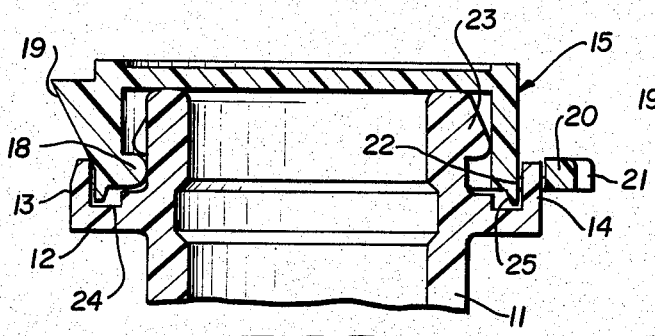
FIG. 5
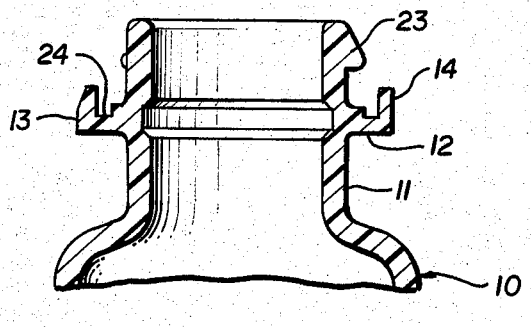
FIG. 4
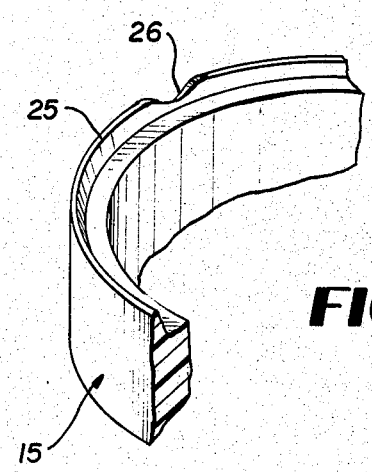
FIG. 6

TAMPER EVIDENT CONTAINER CLOSURE

CROSS-REFERENCE TO RELATED APPLICATION

This application is a continuation-in-part of prior copending application Ser. No. 06/448,303, filed Dec. 9, 1982, for TAMPER EVIDENT CHILD-RESISTANT CONTAINER CLOSURE, now U.S. Pat. No. 4,457,437.

BACKGROUND OF THE INVENTION

The prior application discloses a tamper evident closure for containers of potentially hazardous materials. The container closure is snap locked into engagement with the neck of the container body in a manner which allows free rotation of the closure in either direction. A cooperative tamper indicating means on the container body and closure including circumferentially spaced frangible parts is provided. At least one frangible part is destroyed during rotation of the closure relative to the container body toward a release position in either direction of rotation.

While the above arrangement in the prior patent application provides an excellent foolproof and simplified tamper indicator means for a child-resistant container and container closure, it has been found that it is sometimes possible to pry the closure cap from the container by using an implement, such as a knife blade, screwdriver or the like. In some cases, the prying operation can be accomplished without leaving any visual evidence, thus defeating the purpose of the invention.

Accordingly, it is the objective of the present invention to deal with the above drawback present in the prior device, and to deal with it completely and successfully in a simple and economical manner.

In accordance with the present invention, the closure cap pry off problem is solved by forming on the side wall of the closure cap a narrow 360° tamper evident extension skirt which is received within a 360° recess formed in the top of the container dust ring when the cap is placed on the container neck. Any prying device which could successfully separate the cap from the container will necessarily damage the extension skirt of the cap and/or recess sufficiently to render the same tamper evident, thus overcoming the difficulty of the prior art.

Other objects and advantages of the invention will become apparent during the course of the following detailed description.

BRIEF DESCRIPTION OF THE DRAWINGS

FIG. 1 is a perspective view of a container having a tamper evident safety cap according to the invention.

FIG. 2 is a bottom plan view of the container cap having the tamper-evident extension skirt.

FIG. 3 is a vertical section through the cap taken on line 3—3 of FIG. 2.

FIG. 4 is a vertical section taken through the neck of the container showing the dust ring recess.

FIG. 5 is a vertical section taken through the closure cap and container neck in assembled relationship.

FIG. 6 is an enlarged fragmentary perspective view of the cap showing permanent evidence of prying to separate the cap from the container.

DETAILED DESCRIPTION

Referring to the drawings in detail wherein like numerals designate like parts, the numeral 10 designates a container for medicines and the like formed of molded plastics, having a neck 11 carrying the customary dust ring 12 formed integrally therewith, and disposed at an elevation well below the mouth of the neck 11.

As disclosed in the referenced parent application, a pair of severing lugs 13 and 14 are formed integrally on the dust ring 12 and project above the same.

A removable closure cap 15 also molded from plastics material includes an annular side wall on the interior of which are located a pair of arcuate ribs 16 separated by a gap 17. Each rib 16 spans approximately one-quarter of the cap's circumference on opposite sides of the gap 17, which is relatively narrow. Diametrically opposite from the gap 17 on the interior of the cap side wall is a locking tab 18 having a width similar to that of the gap 17. At the same circumferential location on the cap 15, but on its exterior, a cap lifting projection 19 is provided, exactly as described in the prior application.

A tamper indicating element in the form of a short arcuate bar 20 having divergent extension arms 21 is disposed exteriorly of the cap side wall near its bottom edge. The bar 20 is integrally connected to the cap by a pair of thin frangible radial connecting tabs 22 which are spaced apart circumferentially on the cap 15. The tamper indicating bar 20 and its frangible tabs 22 are located substantially at the elevation of the ribs 16 and locking tab 18. The construction of the cap 15, as thus far described, is exactly the same as the closure cap in the prior application. It should also be noted that the container neck 11 above its dust ring 12 is provided with an exterior annular bead 23, interrupted at one point in its circumference by a gap of sufficient width to receive therethrough the cap locking tab 18. This arrangement is also in accordance with the teaching of the prior application.

With the cap applied to the container neck, its ribs 16 and locking tab 18 are disposed below the interrupted bead 23, and the cap may rotate freely on the container in either direction. The severing lugs 13 and 14 of dust ring 12 are in the rotational path of movement of the frangible tabs 22 which are initially intact. When the user rotates the cap 15 in either direction to position it at the release point, one of the two frangible tabs 22 will necessarily be severed by one of the severing lugs 13 or 14, as described in the prior application, thus clearly evidencing tampering with the container prior to its sale.

In accordance with the essence of the improvement provided by the present invention which renders the container cap 15 tamper evident as a result of any effort to pry the cap off of the container neck, the following arrangement is provided.

The top face of the dust ring 12 immediately inwardly of severing lugs 13 and 14 is provided with a shallow continuous 360° recess 24. A coacting radially thin continuous depending 360° tamper evident extension skirt 25 is formed integrally on the side wall of cap 15. When the cap is engaged with the container neck, the extension skirt 25 is received in the dust ring recess 24 in interfitting relationship with the latter.

If an effort is made to pry off the cap 15 with any type of blade implement, the insertion of such implement under the extension skirt 25 while the latter is within the recess 24 will inevitably permanently damage or deform the extension skirt, as indicated by the numeral 26 in FIG. 6, thus rendering the cap tamper evident as a result of the prying operation.

It can be seen that through the invention the cap is rendered tamper evident as a result of any effort to remove the cap prior to sale by cap rotation or by prying the cap upwardly. In short, it is impossible to remove the cap in any manner from the container without creating permanent visual evidence of tampering in accordance with the objectives of this invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A tamper evident container and container closure arrangement comprising an interengaging container neck and freely rotatable container neck cap, cooperative means on said container neck and cap operable to impart to the cap permanent visual evidence of tampering in response to rotation of the cap in any direction to a cap release position, and separate cooperative means on said container neck and cap operable to impart to the cap permanent visual evidence of tampering as a result of prying the cap upwardly to separate it from the container neck.

2. A tamper evident container and container closure arrangement as defined in claim 1, and the separate cooperative means comprising an upwardly open annular recess on the container neck substantially aligned axially with the side wall of said cap and the lower edge portion of the cap side wall engaging within said annular recess when the cap is applied to the container neck.

3. A tamper evident container and container closure arrangement as defined in claim 2, and the container neck having an external annular dust ring thereon, said annular recess comprising a recess in the top face of the dust ring, and the lower edge portion of the cap comprising a radially thin dependent annular extension skirt on the cap side wall projecting downwardly into said recess and being permanently visually damaged by any effort to pry the cap upwardly to dislodge it from the container by insertion of a prying implement into said recess.

4. A tamper evident child-resistant closure for a container having a neck and a dust ring on said neck, a closure cap appliable to the neck and having an annular side wall engaging telescopically over the neck in axially opposing relation to said dust ring, releasable interlocking means on said neck and cap side wall resisting lifting of the cap from the neck except in one release position and allowing free rotation of the cap in any direction, tamper evident means on the cap and container neck to permanently visually indicate rotation of the cap in any direction to its release position, and tamper evident means on said dust ring and cap side wall in interfitting relationship while the cap is held on said neck by said releasable interlocking means.

5. A tamper evident child-resistant closure for a container as defined in claim 4, and said tamper evident means on said dust ring and cap side wall comprising a continuous recess in the top face of the dust ring, and a depending extension skirt on the lower edge of the cap side wall adapted to be permanently deformed by any cap prying implement.

6. A tamper evident child-resistant closure for a container as defined in claim 5, and said extension skirt being comparatively thin radially and substantially thinner than the thickness of the cap side wall from which it depends.

* * * * *